US007381298B2

(12) United States Patent
Schwonke

(10) Patent No.: US 7,381,298 B2
(45) **Date of Patent: *Jun. 3, 2008**

(54) PROCESS FOR MAKING A PAPERBOARD FROM A HIGH CONSISTENCY SLURRY CONTAINING HIGH LEVELS OF CROSSLINKED CELLULOSIC FIBERS

(75) Inventor: Paul A. Schwonke, Seattle, WA (US)

(73) Assignee: Weyerhaeuser Company, Federal Way, WA (US)

( * ) Notice: Subject to any disclaimer, the term of this patent is extended or adjusted under 35 U.S.C. 154(b) by 429 days.

This patent is subject to a terminal disclaimer.

(21) Appl. No.: 11/027,118

(22) Filed: Dec. 30, 2004

(65) Prior Publication Data

US 2006/0144538 A1 Jul. 6, 2006

(51) Int. Cl.
*D21F 11/00* (2006.01)

(52) U.S. Cl. ..... 162/123; 162/129; 162/157.6; 162/202; 162/204

(58) Field of Classification Search ..... 162/123, 162/129, 157.6, 202, 204
See application file for complete search history.

(56) References Cited

U.S. PATENT DOCUMENTS

| | | | | |
|---|---|---|---|---|
| 3,224,926 | A | | 12/1965 | Bernadin |
| 3,241,533 | A | | 3/1966 | Balmer |
| 3,440,135 | A | | 4/1969 | Chung |
| 3,526,048 | A | | 9/1970 | Rowland et al. |
| 3,658,613 | A | | 4/1972 | Steiger |
| 3,756,913 | A | | 9/1973 | Wodka |
| 3,819,470 | A | | 6/1974 | Shaw et al. |
| 3,932,209 | A | | 1/1976 | Chatterjee |
| 4,035,147 | A | | 7/1977 | Sangenis |
| 4,285,690 | A | | 8/1981 | North |
| 4,332,586 | A | | 6/1982 | North |
| 4,391,878 | A | | 7/1983 | Drach |
| 4,396,391 | A | | 8/1983 | North |
| 4,420,368 | A | | 12/1983 | Drach et al. |
| 4,431,481 | A | | 2/1984 | Drach et al. |
| 4,455,416 | A | | 6/1984 | Floyd et al. |
| 4,505,712 | A | | 3/1985 | Floyd et al. |
| 4,619,736 | A | * | 10/1986 | Henricson et al. ..... 162/261 |
| 4,820,307 | A | | 4/1989 | Welch et al. |
| 4,822,453 | A | | 4/1989 | Dean et al. |
| 4,853,086 | A | | 8/1989 | Graef et al. |
| 4,869,118 | A | | 9/1989 | Keller |
| 4,888,093 | A | | 12/1989 | Dean et al. |
| 4,889,595 | A | | 12/1989 | Herron et al. |
| 4,889,596 | A | | 12/1989 | Schoggen et al. |
| 4,889,597 | A | | 12/1989 | Bourbon et al. |
| 4,898,642 | A | | 2/1990 | Moore et al. |
| 4,900,324 | A | | 2/1990 | Chance et al. |
| 4,913,773 | A | | 4/1990 | Knudsen et al. |
| 4,935,022 | A | | 6/1990 | Lash et al. |
| 4,936,865 | A | | 6/1990 | Welch et al. |
| 4,968,774 | A | | 11/1990 | Didier et al. |
| 4,975,209 | A | | 12/1990 | Welch et al. |
| 5,049,235 | A | | 9/1991 | Barcus et al. |
| 5,137,537 | A | | 8/1992 | Herron et al. |
| 5,160,789 | A | | 11/1992 | Barcus et al. |
| 5,183,707 | A | | 2/1993 | Herron |
| 5,190,563 | A | | 3/1993 | Herron et al. |
| 5,221,285 | A | | 6/1993 | Andrews et al. |
| 5,225,047 | A | | 7/1993 | Graef et al. |
| 5,366,591 | A | | 11/1994 | Jewell |
| 5,442,899 | A | | 8/1995 | Shibazi et al. |
| 5,496,476 | A | | 3/1996 | Tang et al. |
| 5,496,477 | A | | 3/1996 | Tang et al. |
| 5,536,369 | A | | 7/1996 | Norlander |
| 5,547,083 | A | * | 8/1996 | Alajaaski et al. ..... 209/273 |
| 5,549,791 | A | | 8/1996 | Herron et al. |
| 5,556,976 | A | | 9/1996 | Jewell |
| 5,562,740 | A | | 10/1996 | Cook et al. |
| 5,698,074 | A | | 12/1997 | Barcus et al. |
| 5,705,475 | A | | 1/1998 | Tang et al. |
| 5,728,771 | A | | 3/1998 | Tang et al. |
| 5,840,787 | A | | 11/1998 | West et al. |
| 5,843,061 | A | | 12/1998 | Chauvette et al. |
| 5,873,979 | A | | 2/1999 | Naieni |
| 5,981,739 | A | | 11/1999 | Anderson et al. |
| 5,998,511 | A | | 12/1999 | Westland et al. |
| 6,133,170 | A | | 10/2000 | Suenaga et al. |
| 6,224,954 | B1 | | 5/2001 | Mitchell et al. |
| 6,379,497 | B1 | | 4/2002 | Sandstrom et al. |
| 6,537,680 | B1 | | 3/2003 | Norlander et al. |
| 6,582,553 | B2 | | 6/2003 | Jewell et al. |
| 6,620,293 | B2 | * | 9/2003 | Sears et al. ..... 162/157.6 |
| 2002/0012759 | A1 | | 1/2002 | Asayama et al. |
| 2002/0060004 | A1 | | 5/2002 | Motomu |
| 2003/0155088 | A1 | | 8/2003 | Norlander |

FOREIGN PATENT DOCUMENTS

| | | |
|---|---|---|
| WO | WO 95/26441 A1 | 10/1995 |
| WO | WO 97/45589 A1 | 12/1997 |
| WO | WO 01/29311 A1 | 4/2001 |
| WO | WO 01/54988 A2 | 8/2001 |

* cited by examiner

*Primary Examiner*—Mark Halpern

(57) ABSTRACT

A process is described for manufacturing a paperboard from a high consistency slurry containing high levels of crosslinked cellulosic fibers by dispersing the fibers in a screen with a rotor in the screen and then passing the fibers through the screen basket with a hole diameter of at least 2 mm and forming the cellulosic fibers on a foraminous support. Another slurry of regular cellulosic fibers is deposited on at least one side of the first slurry during the formation process. The formed web is dewatered and dried.

14 Claims, 6 Drawing Sheets

*Fig.* 5

PROCESS FOR MAKING A PAPERBOARD FROM A HIGH CONSISTENCY SLURRY CONTAINING HIGH LEVELS OF CROSSLINKED CELLULOSIC FIBERS

FIELD

The present application relates to a process for manufacturing a paperboard from a high consistency pulp slurry of cellulosic fibers containing high levels of intrafiber crosslinked celluosic fibers.

SUMMARY

This application is directed to a process for manufacturing a paperboard from a high consistency pulp slurry containing high levels of crosslinked cellulosic fibers by dispersing the fibers in a screen with a rotor in the screen and then passing the fibers through the screen basket with a hole diameter of at least 2 mm and forming the cellulosic fibers on a foraminous support. Another slurry of regular cellulosic fibers is deposited on at least one side of the first slurry during the formation process.

BRIEF DESCRIPTION OF THE DRAWINGS

The foregoing aspects and many of the attendant advantages of this disclosure will become more readily appreciated as the same become better understood by reference to the following detailed description, when taken in conjunction the accompanying drawings, wherein.

DETAILED DESCRIPTION

High consistency slurries containing high levels of crosslinked cellulosic fibers cannot be used in paperboard machines due to plugging of the screen by the high levels of crosslinked cellulosic fibers in the slurry. A process for using the high consistency slurry containing high levels of crosslinked cellulosic fibers has been discovered which overcomes this problem.

Figure 1:
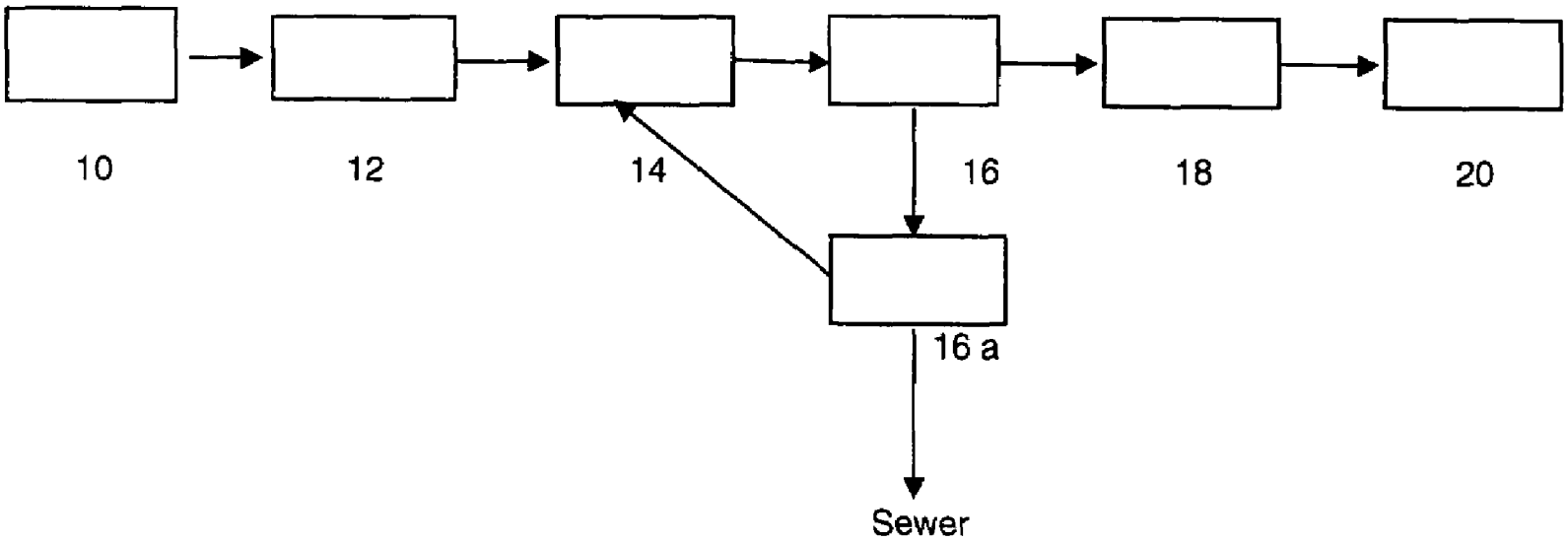
FIG. 1 is a schematic representation of the equipment components utilized in the present application.
Figure 2:
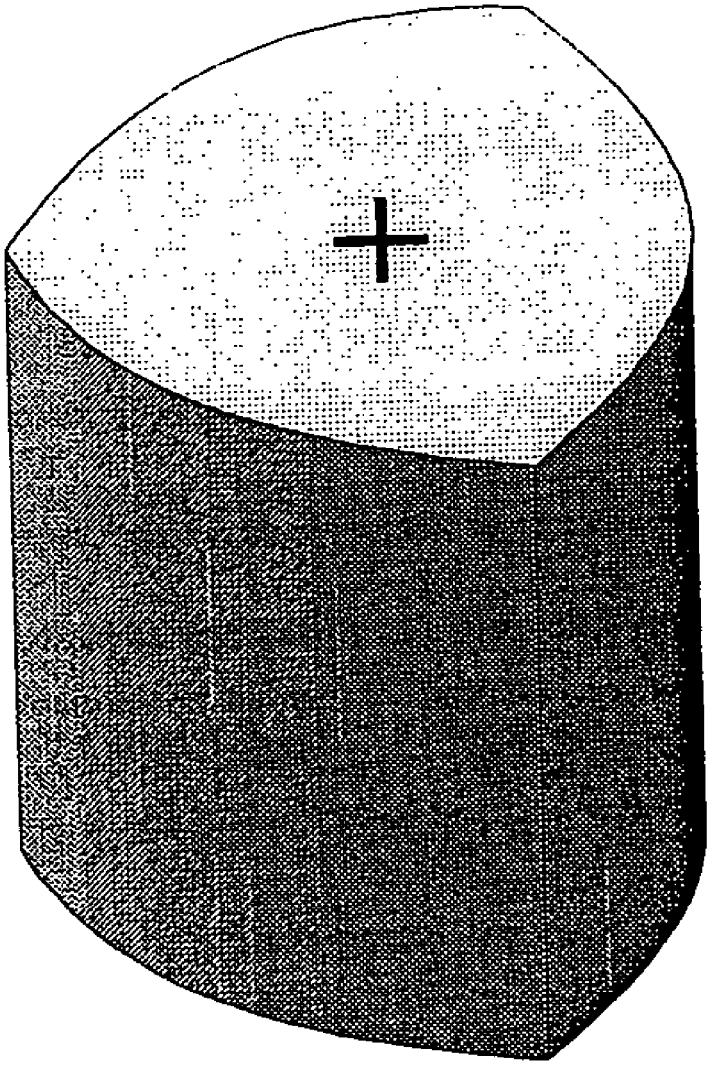
FIG. 2 is a lobed rotor.
Figure 3:
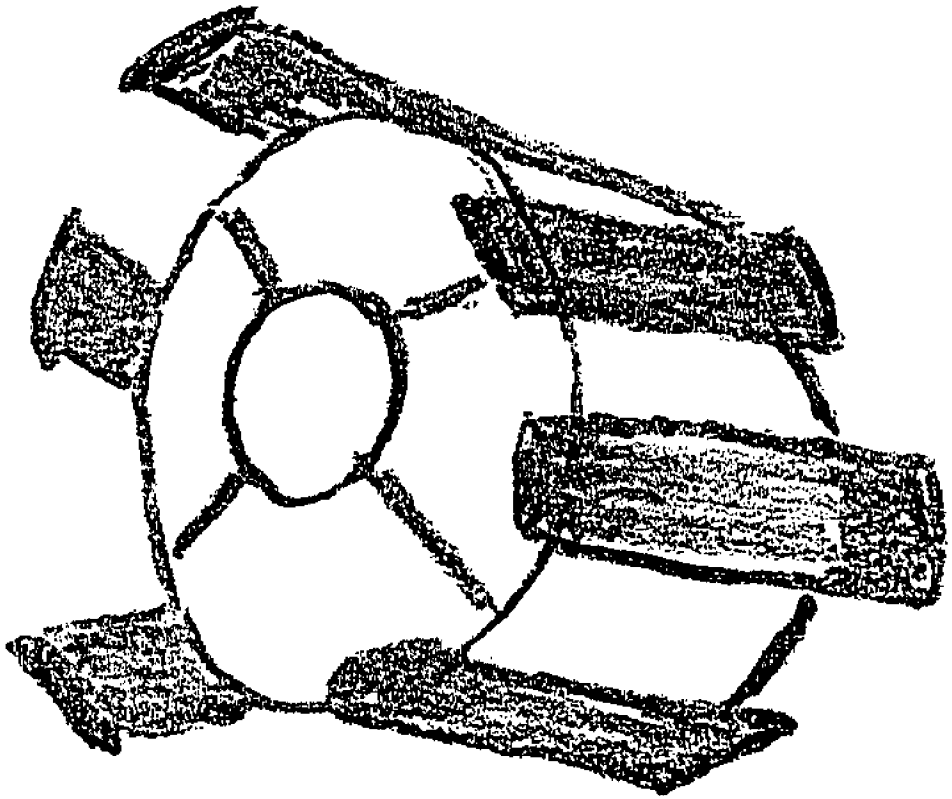
FIG. 3 is a foil rotor.
Figure 4:
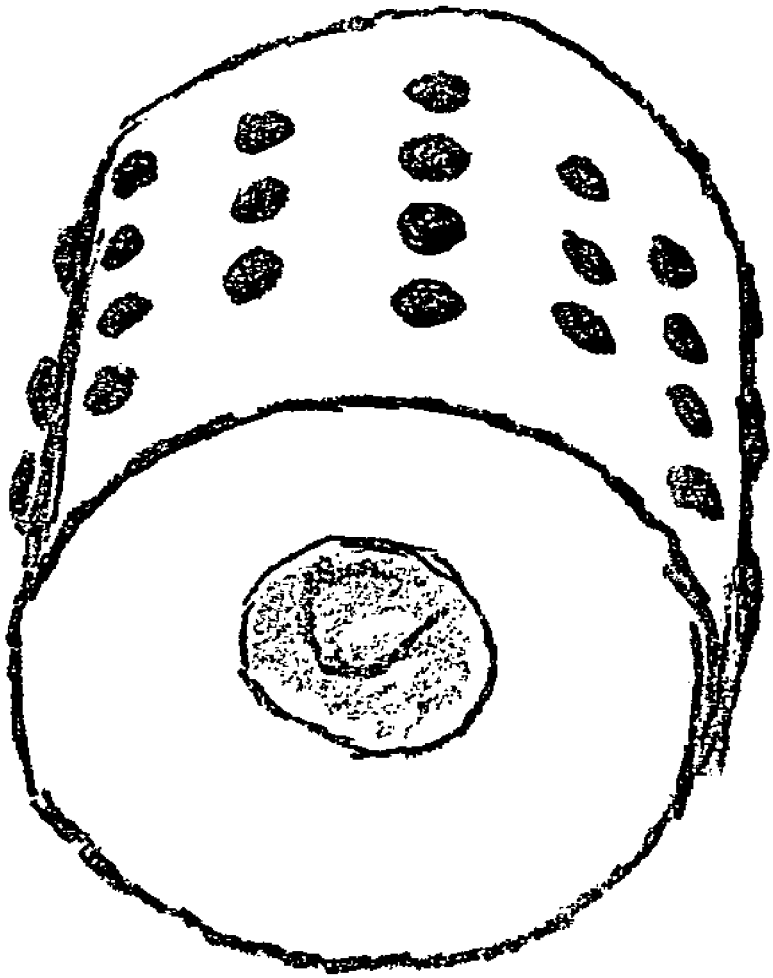
FIG. 4 is a bump rotor.

Referring to FIG. 1, a high consistency slurry of cellulosic fibers is formed in a dispersion medium, such as water, in a slurry tank, 10. The resulting slurry is then pumped to a consistency regulator, 12, where dilution water is added to maintain a fixed consistency. Subsequently the slurry is pumped to the machine chest, 14, and then into a screen basket, 16, which may be vertically or horizontally mounted. Various types of rotors may be mounted in the screen basket such as a lobed, foil or bump rotor (see FIGS. 2, 3, and 4) manufactured by GL&V, Watertown, N.Y. The rotors serve to disperse the fibers in the screen and force acceptable fibers through the screen basket and then to a headbox 18. Fibers tat are rejected pass to a flat screen, 16 a, where they are further separated into rejects which are discarded and acceptable fibers which are returned to the machine chest, 14. The headbox may be a single ply headbox, a multiply headbox or two or more single ply headboxes arranged to form two or more layers formed by combining one layer from each single ply headbox. From the headbox, the pulp is formed on the wire, 20, dewatered and dried.

In one embodiment of the method, at least one high consistency slurry of cellulosic fibers is formed in an aqueous dispersion medium. The cellulosic fibers which are both crosslinked cellulosic fibers and regular cellulosic fibers, are dispersed in a screen by means of a rotor in the screen and then passed through the screen which has a hole diameter of at least 1.5 mm. The cellulosic fibers are formed on a foraminous support. Rotors can be of various types such as lobed, foil, bump, and S; the listing is not meant to limit the types suitable for this application and known by the skilled artisan. In another embodiment the fibers are passed through a screen which has a hole diameter of at least 2 mm. Screen hole sizes up to 6 mm can be used. As used herein, the term "consistency" means the percent solids content of a liquid and solid mixture, for example, a consistency of 2 percent cellulosic fibers means there are two grams of cellulosic fibers in one hundred grams of fiber and liquid. In another embodiment the slurry consistency is at least 2.5 percent and in yet another embodiment the slurry consistency is at least 3 percent. A high consistency slurry means a solid content of 3 to 4 percent, a medium consistency slurry means a solid content of 1 to 2 percent and a low consistency slurry means a solid content of less than 1 percent solids.

Crosslinked cellulosic fibers can be present in the high consistency slurry at levels of at least 35 percent by weight of the total fibers in the high consistency slurry. In one embodiment they are present at a level of at least 40 percent by weight of the total fiber content in the high consistency slurry. In another embodiment they are present at a level of at least 50 percent by weight of the total fiber content in the high consistency slurry and in yet another embodiment they are present at a level of at least 60 percent by weight of the total fiber in the high consistency slurry.

The preferred crosslinked cellulosic fibers for use in the application are crosslinked cellulosic fibers. Any one of a number of crosslinking agents and crosslinking catalysts, if necessary, can be used to provide the crosslinked fibers to be included in the layer. The following is a representative list of useful crosslinking agents and catalysts. Each of the patents noted below is expressly incorporated herein by reference in its entirety.

Suitable urea-based crosslinking agents include substituted ureas, such as methylolated ureas, methylolated cyclic ureas, methylolated lower alkyl cyclic ureas, methylolated dihydroxy cyclic ureas, dihydroxy cyclic ureas, and lower alkyl substituted cyclic ureas. Specific urea-based crosslinking agents include dimethyldihydroxy urea (DMDHU, 1,3-dimethyl-4,5-dihydroxy-2-imidazolidinone), dimethyloldihydroxy-ethylene urea (DMDHEU, 1,3-dihydroxymethyl-4,5-dihydroxy-2-imidazolidinone), dimethylol urea (DMU, bis[N-hydroxymethyl]urea), dihydroxyethylene urea (DHEU, 4,5-dihydroxy-2-imidazolidinone), dimethylolethylene urea (DMEU, 1,3-dihydroxymethyl-2-imidazolidinone), and dimethyldihydroxyethylene urea (DMeDHEU or DDI, 4,5-dihydroxy-1,3-dimethyl-2-imidazolidinone).

Suitable crosslinking agents include dialdehydes such as $C_2$-$C_8$ dialdehydes (e.g., glyoxal), $C_2$-$C_8$ dialdehyde acid analogs having at least one aldehyde group, and oligomers of these aldehyde and dialdehyde acid analogs, as described in U.S. Pat. Nos. 4,822,453; 4,888,093; 4,889,595; 4,889,596; 4,889,597; and 4,898,642. Other suitable dialdehyde crosslinking agents include those described in U.S. Pat. Nos. 4,853,086; 4,900,324; and 5,843,061. Other suitable crosslinking agents include aldehyde and urea-based form-aldehyde addition products. See, for example, U.S. Pat. Nos. 3,224,926; 3,241,533; 3,932,209; 4,035,147; 3,756,913; 4,689,118; 4,822,453; 3,440,135; 4,935,022; 3,819,470; and 3,658,613. Suitable crosslinking agents may also include glyoxal adducts of ureas, for example, U.S. Pat. No. 4,968,774, and glyoxal/cyclic urea adducts as described in U.S. Pat. Nos. 4,285,690; 4,332,586; 4,396,391; 4,455,416; and 4,505,712.

Other suitable crosslinking agents include carboxylic acid crosslinking agents such as polycarboxylic acids. Polycarboxylic acid crosslinking agents (e.g., citric acid, propane tricarboxylic acid, and butane tetracarboxylic acid) and catalysts are described in U.S. Pat. Nos. 3,526,048; 4,820,307; 4,936,865; 4,975,209; and 5,221,285. The use of $C_2$-$C_9$ polycarboxylic acids that contain at least three carboxyl groups (e.g., citric acid and oxydisuccinic acid) as crosslinking agents is described in U.S. Pat. Nos. 5,137,537; 5,183,707; 5,190,563; 5,562,740; and 5,873,979.

Polymeric polycarboxylic acids are also suitable crosslinking agents. Suitable polymeric polycarboxylic acid crosslinking agents are described in U.S. Pat. Nos. 4,391,878; 4,420,368; 4,431,481; 5,049,235; 5,160,789; 5,442,899; 5,698,074; 5,496,476; 5,496,477; 5,728,771; 5,705,475; and 5,981,739. Polyacrylic acid and related copolymers as crosslinking agents are described U.S. Pat. Nos. 5,549,791 and 5,998,511. Polymaleic acid crosslinking agents are described in U.S. Pat. No. 5,998,511 and U.S. application Ser. No. 09/886,821.

Specific suitable polycarboxylic acid crosslinking agents include citric acid, tartaric acid, malic acid, succinic acid, glutaric acid, citraconic acid, itaconic acid, tartrate monosuccinic acid, maleic acid, polyacrylic acid, polymethacrylic acid, polymaleic acid, polymethylvinylether-co-maleate copolymer, polymethylvinylether-co-itaconate copolymer, copolymers of acrylic acid, and copolymers of maleic acid. Other suitable crosslinking agents are described in U.S. Pat. Nos. 5,225,047; 5,366,591; 5,556,976; and 5,536,369.

Suitable crosslinking catalysts can include acidic salts, such as ammonium chloride, ammonium sulfate, aluminum chloride, magnesium chloride, magnesium nitrate, and alkali metal salts of phosphorous-containing acids. In one embodiment, the crosslinking catalyst is sodium hypophosphite.

The crosslinking agent is applied to the cellulosic fibers as they are being produced in an amount sufficient to effect intrafiber crosslinking. The amount applied to the cellulosic fibers may be from about 1% to about 25% by weight based on the total weight of fibers. In one embodiment, crosslinking agent in an amount from about 4% to about 6% by weight based on the total weight of fibers. Mixtures or blends of crosslinking agents may be used.

Although available from other sources, noncrosslinked cellulosic fibers usable in the present application are derived primarily from wood pulp. Suitable wood pulp fibers for use with the application can be obtained from well-known chemical processes such as the kraft and sulfite processes, with or without subsequent bleaching. Pulp fibers can also be processed by thermomechanical, chemithermomechanical methods, or combinations thereof. The preferred pulp fiber is produced by chemical methods. Groundwood fibers, recycled or secondary wood pulp fibers, and bleached and unbleached wood pulp fibers can be used. Softwoods and hardwoods can be used. Details of the selection of wood pulp fibers are well known to those skilled in the art. These fibers are commercially available from a number of companies, including Weyerhaeuser Company, the assignee of the present invention. For example, suitable cellulose fibers produced from southern pine that are usable with the present application are available from Weyerhaeuser Company under the designations CF416, CF405, NF405, PL416, FR416, FR516, and NB416. Dissolving pulps from northern softwoods include MAC11 Sulfite, M919, WEYCELL and TR978 all of which have an alpha content of 95% and PH which has an alpha content of 91%. High purity mercerized pulps such as HPZ, HPZ111, HPZ4, and HPZ-XS available from Buckeye and Porosonier-J available from Rayonier are also suitable.

Screen hole diameter can vary. In one embodiment the hole diameter is at least 2 mm, in another embodiment the hole diameter is at least 3 mm. Rotors in the screen used to disperse the fibers and force the fibers through the screen can be lobed, bump or foil rotors. Foil rotors can have from four to ten foils.

Hot foods, particularly hot liquids, are commonly served and consumed in disposable containers. These containers are made from a variety of materials including paperboard and foamed polymeric sheet material. One of the least expensive sources of paperboard material is cellulose fibers. Cellulose fibers are employed to produce excellent paperboards for the production of hot cups, paper plates, and other food and beverage containers. Conventional paperboard produced from cellulosic fibers, however, is relatively dense, and therefore, transmits heat more readily than, for example, foamed polymeric sheet material. Thus, hot liquids are typically served in double cups or in cups containing multiple plies of conventional paperboard.

It is desirable to manufacture a paperboard produced from cellulosic material that has good insulating characteristics, that will allow the user to sense that food in the container is warm or hot and at the same time will allow the consumer of the food beverage in the container to hold the container for a lengthy period of time without the sensation of excessive temperature. It is further desirable to provide a paperboard that can be tailored to provide a variety of insulating characteristics.

Figure 5:
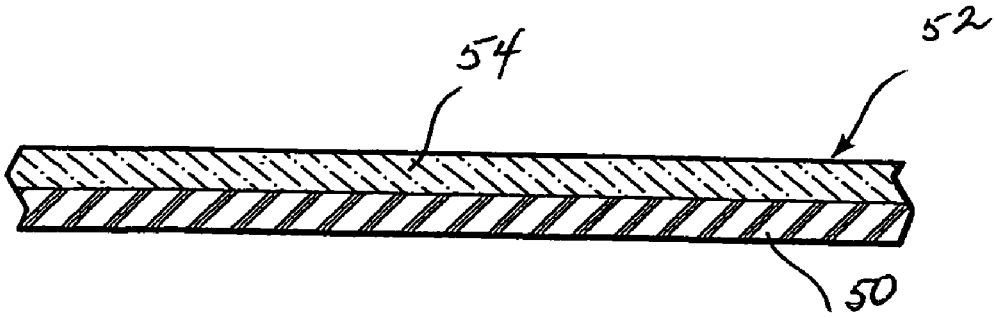
FIG. 5 is a schematic cross-sectional view of a two ply paperboard.

Referring to FIG. 5, the substrate 50 for the insulating paperboard 52 of the present application is produced in a conventional manner from readily available fibers such as cellulosic fibers. At least one ply, 54, of the paperboard contains crosslinked fibers. The paperboard of the present application can be made in a single-ply, a two-ply construction, or a multi-ply construction, as desired. While the paperboard of the present application may employ synthetic fibers as set forth above, it is most preferred that paperboard comprise all or substantially all of the cellulosic fibers.

The distinguishing characteristic of the present application is that at least one ply of the paperboard, whether a single-ply or a multiple-ply structure, contains crosslinked cellulosic fibers. The crosslinked cellulosic fibers increase the bulk density of the paperboard and thus the insulating characteristics. As used herein, crosslinked cellulosic fibers are kinked, twisted, curly, cellulosic fibers. It is preferred, however, that the fibers be produced by intrafiber crosslinking of the cellulosic fibers as described earlier.

Paperboard of the present application may have a broad set of characteristics. For example, its basis weight can range from 200 gsm to 500 gsm, more preferably, from 250 gsm to 400 gsm. Most preferably, the basis weight of the paperboard is equal to or greater than 250 gsm. To achieve the insulating characteristics of the present invention, it is preferred that the paperboard has a density of less than 0.5 g/cc, more preferably, from 0.3 g/cc to 0.45 g/cc, and most preferably, from 0.35 g/cc to 0.40 g/cc.

When at least one ply of the paperboard contains crosslinked cellulosic fibers in accordance with the present invention, advantageous temperature drop characteristics can be achieved. These temperature drop characteristics can be achieved by altering the amount of crosslinked cellulosic fiber introduced into the paperboard, by adjusting the basis weight of the paperboard, by adjusting the caliper of the paperboard after it has been produced by running it, for example, through nip rolls, and of course, by varying the number and thickness of additional plies incorporated in the paperboard structure. It is preferred that this paperboard have a caliper greater than or equal to 0.5 mm, a basis weight equal to or greater than 250 gsm, and a density less than 0.5 g/cc defined below.

The paperboard of the present application can be a single-ply product. When a single-ply product is employed, the low density characteristics of the paperboard allow the manufacture of a thicker paperboard at a reasonable basis weight. To achieve the same insulating characteristics with a normal paperboard, the normal paperboard thickness would have to be doubled relative to that of the present invention. Using the crosslinked cellulosic fibers of the present invention, an insulating paperboard having the same basis weight as a normal paperboard can be made. This effectively allows the manufacture of insulating paperboard on existing paperboard machines with minor modifications and minor losses in productivity. Moreover, a one-ply paperboard has the advantage that the whole structure is at a low density.

Alternatively, the paperboard of the application can be multi-ply product, and include two, three, or more plies. Paperboard that includes more than a single-ply can be made by combining the plies either before or after drying. It is preferred, however, that a multi-ply paperboard be made by using multiple headboxes arranged sequentially in a wet-forming process, or by a baffled headbox having the capacity of receiving and then laying multiple pulp furnishes. The individual plies of a multi-ply product can be the same or different.

The paperboard of the present application can be formed using conventional papermaking machines including, for example, Rotoformer, Fourdrinier, cylinder, inclined wire Delta former, and twin-wire forming machines.

When a single-ply paperboard is used in accordance with the present invention, it is preferably homogeneous in composition. The single ply, however, may be stratified with respect to composition and have one stratum enriched with crosslinked cellulosic fibers and another stratum enriched with non-crosslinked cellulosic fibers. For example, one surface of the paperboard may be enriched with crosslinked cellulosic fibers to enhance that surface's bulk and the other surface enriched with non-crosslinked fibers to provide a smooth, denser, less porous surface.

The most economical paperboard to produce is homogeneous in composition. The crosslinked cellulosic fibers are uniformly intermixed with the regular cellulosic fibers. For example, in the headbox furnish it is preferred that the crosslinked cellulosic fibers present in high consistency slurry be present in an amount from about 25% to about 100%, and more preferably from about 30% to about 70%. In one embodiment the crosslinked cellulosic fibers are present at a level of at least 35 percent by weight of the total fiber content. In another embodiment the crosslinked fibers are present at a level of alt least 50 percent by weight of total fiber content. In yet another embodiment the crosslinked fibers are present at a level of at least 60 percent by weight of the total fiber content. In a two-ply structure, for example, the first ply may contain 100% non-crosslinked cellulosic fibers while the second ply may contain from 25% to 100% crosslinked cellulosic fibers or from 30% to 70% crosslinked cellulosic fibers. In a three-ply layer, for example, the bottom and top layers may comprise 100% of non-crosslinked cellulosic fibers while the middle layer contains from about 25% to about 100% and preferably from about 30% to about 70% of crosslinked cellulosic fibers.

When crosslinked cellulosic fibers are used in paperboard in accordance with the present invention, it has been found that the paperboard exiting the papermaking machine can be compressed to varying degrees to adjust the temperature drop characteristics across the paperboard. The paperboard once leaving the papermaking machine may be compressed or reduced in caliper by up to 50%, and more preferably, from 15% to 25%. This same result can be achieved by lowering the basis weight of the paperboard.

Figure 6:
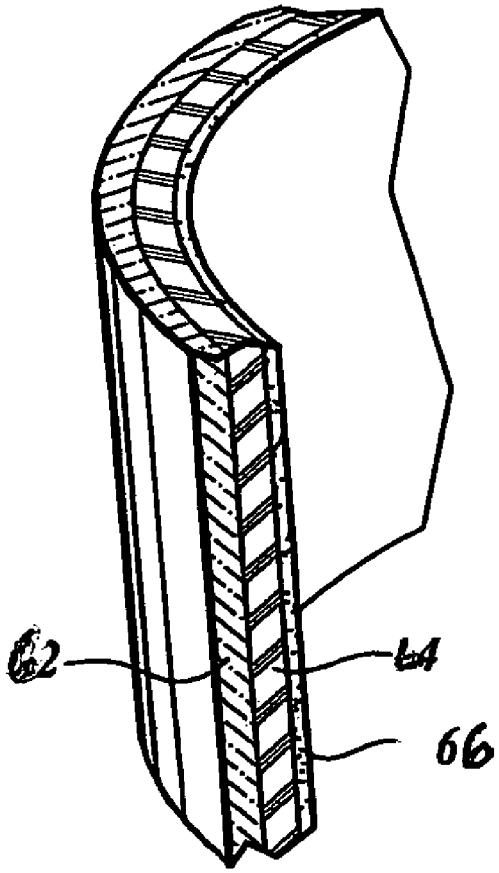
FIG. 6 shows a wall section of a hot cup container.

The paperboard of the present application can be utilized to make a variety of structures, particularly containers, in which it is desired to have insulating characteristics. One of the most common of these containers is the ubiquitous hot cup utilized for hot beverages such as coffee, tea, and the like. Other insulating containers such as the ordinary paper plate can also incorporate the paperboard of the present invention. Also, carry-out containers conventionally produced of paperboard or of foam material can also employ the paperboard of the present invention. FIG. 6 shows a wall section of a hot cup type container produced which may comprise one or more plies 62 and 64, one of which, in this instance, 64, contains crosslinked cellulosic fibers. In this embodiment the crosslinked cellulosic fibers are in the interior ply 64. A liquid impervious backing is preferably extruded or poly coated to the interior ply coated to the. The backing may comprise, for example, a variety of thermoplastic materials, such as polyethylene. It is preferred that the paperboard used in the bottom of the cup contain no bulky fibers.

EXAMPLES 1-9

High consistency slurries were prepared at a 3.2 percent consistency containing 50 to 65 percent by weight citric acid crosslinked cellulosic fibers. The crosslinked fiber was deflaked with a standard Beloit Jones refiner with a zero load. Douglas Fir cellulosic fibers were used as the other component in the high consistency slurry. In some cases the Douglas Fir was refined to 650 CSF. A screen hole size of 2 mm was used in all cases. A rotor with six foils, a bump rotor and a lobed rotor, all well known in the art and manufactured by GL&V, Watertown, N.Y., were used in the screen for different trials. Trials were conducted on a pilot screen machine at GL&V, Watertown, N.Y., that allowed stock to be recirculated through the unit back to the screen tank pump. Flow rates ranged from approximately 3785 l/m (1000 gpm) to 5678 l/m (1500 gpm). Fiber reject rates were run at 10 to 13 percent.

TABLE 1

Screen Trials

| Condition | Deflaked HBA | Consistency | Doug Fir | Basket Hole size, mm | Rotor |
|---|---|---|---|---|---|
| 2 | 53% | 1% | non refined | 2 | 6 foils |
| 1 | 53% | 3.2% | non refined | 2 | 6 foils |
| 3 | 60% | 3.2% | non refined | 2 | bump |
| 4 | 60% | 3.2% | non refined | 2 | lobed |
| 5 | 60% | 3.2% | non refined | 2 | lobed |

TABLE 1-continued

Screen Trials

| Condition | Deflaked HBA | Consistency | Doug Fir | Basket Hole size, mm | Rotor |
|---|---|---|---|---|---|
| 6 | 60% | 3.2% | non refined | 2 | lobed |
| 7 | 60% | 3.2% | non refined | 2 | lobed |
| 8 | 65% | 3.2% | 650 CSF | 2 | lobed |
| 9 | 65% | 3.2% | 650 CSF | 2 | lobed |

Condition 2 ran well at 10 percent reject rates and feed rates of 3255 l/m (860 gpm) to 5300 l/m (1400 gpm). Condition 1 ran at a reject rate of 17% but when the reject rate was reduced, the reject line plugged into the center of the screen basket with thick stock.

Condition 3 was run with GL&V's barracuda rotor, a bump rotor, in a random pattern. The run was started with a full reject line but as soon as the accepts line was opened, the flow started to fall off due to stock thickening. The rotor is noted for tendency to fractionate fiber.

All the remaining runs ran well as follows:

Condition 4, the run was made with an 11% reject rate, 0.14 kPa (3 lb) differential pressure to the screen and a rotor speed of 900 RPM. Increasing the rotor speed to 1000 RPM had no impact.

Condition 5, the rotor speed was dropped to 800 RPM, at this point the reject flow started to drop off and the rotor speed was returned to 900.

Condition 6 was the same as condition 4.

Condition 7, the inlet pressure was increased 0.48 kPa (10 lb), feed flow increased from 900 GPM to 4164 l/m (1100 GPM) and the differential pressure increased to 0.17 (3.5 lb). This condition ran well.

Condition 8 was run at a reject rate of 15% with a 3123 l/m (825 GPM) feed flow rate.

Condition 9 was run at a at 13% reject rate with a 3785 l/m (1000 GPM) feed flow rate.

Theses results indicate that screening at 3.2% consistency and 50% to 65% HBA was successful with a lobed style rotor design.

Fiber samples were obtained from the feed stock, the accepts line and the reject line and microscopically analyzed for fiber content. The results, shown in Table 2, indicate that, using various rotor and the 2 mm screen hole size, there was no selective fractionation of the crosslinked fiber.

TABLE 2

Microstructure - Screen Slush Samples

| Rotor Type | Condition | Bleached Softwood Kraft % | Crosslinked fiber, % |
|---|---|---|---|
| Lobed, F | 9 | 40 | 60 |
| Lobed, A | 9 | 35 | 65 |
| Lobed, R | 9 | 38 | 62 |
| 6 Foils, F | 1 | 46 | 54 |
| 6 Foils, A | 1 | 44 | 56 |
| 6 Foils, R | 1 | 45 | 55 |
| 6 Foils, F | 2 | 41 | 59 |
| 6 Foils, A | 2 | 41 | 59 |
| 6 Foils, R | 2 | 46 | 54 |
| Bump, F | 3 | 39 | 61 |
| Bump, A | 3 | 39 | 61 |
| Bump, R | 3 | 38 | 62 |

F, feed stock;
A, Accepts;
R, Rejects

EXAMPLE 10

A 3 to 3.2 percent high consistency slurry was prepared containing 40 percent by weight crosslinked cellulosic fibers; Douglas Fir wet lap was used as the regular fiber. A screen with a 4 mm hole diameter and a six foil rotor was used prior to the mid ply headbox. A separate slurry containing only Douglas Fir or Pine fibers was refined to 500 CSF and diluted to 0.5 percent consistency prior to pumping the slurry to the outer headboxes. A paperboard was formed on a 500 cm paperboard machine.

EXAMPLE 11

A 3 to 3.2 percent high consistency slurry is prepared containing 40 percent by weight crosslinked cellulosic fibers; Douglas Fir wet lap is used as the regular fiber. A screen with a 2 mm hole diameter equipped with a lobed rotor is used prior to the mid-ply headbox. A separate slurry containing only Douglas Fir or Pine fibers is refined to 500 CSF and diluted to 0.5 percent consistency prior to pumping the slurry to the outer headboxes. A paperboard is formed on a 500 cm paperboard machine.

EXAMPLE 12

A 3 to 3.2 percent high consistency slurry is prepared containing 50 percent by weight crosslinked cellulosic fibers; Douglas Fir wet lap is used as the regular fiber. A screen with a 2 mm hole diameter equipped with a lobed rotor is used prior to the mid-ply headbox. A separate slurry containing only Douglas Fir or Pine fibers is refined to 500 CSF and diluted to 0.5 percent consistency prior to pumping the slurry to the outer headboxes. A paperboard is formed on a 500 cm paperboard machine.

EXAMPLE 13

A 3 to 3.2 percent high consistency slurry is prepared containing 55 percent by weight crosslinked cellulosic fibers; Douglas Fir wet lap is used as the regular fiber. A screen with a 2 mm hole diameter equipped with a lobed rotor is used prior to the mid-ply headbox. A separate slurry containing only Douglas Fir or Pine fibers is refined to 500 CSF and diluted to 0.5 percent consistency prior to pumping the slurry to the outer headboxes. A paperboard is formed on a 500 cm paperboard machine.

The invention claimed is:

1. A process for making a paperboard comprising the steps of forming at least one high consistency first slurry of cellulosic fibers in an aqueous dispersion medium wherein said cellulosic fibers comprise crosslinked cellulosic fibers forming at least one second slurry comprising cellulosic fibers in an aqueous dispersion medium passing said high consistency first slurry through a screen with a hole diameter of at least 2 mm wherein said screen has a rotor for dispersing said high consistency slurry passing said second slurry of cellulosic fibers through a screen with a hole diameter of at least 1 mm forming one of said slurries of cellulosic fibers on a foraminous support forming the other of said slurries on said slurry formed on said foraminous support withdrawing liquid from said slurries formed on said foraminous support drying said formed slurries to form a paperboard.

2. The process of claim 1 wherein the high consistency slurry is at least 3 percent.

3. The process of claim 1 wherein the high consistency slurry is at least 3.2 percent.

4. The process of claim 1 wherein said crosslinked cellulosic fibers are present in at a level of at least 40 percent by weight of the total fiber in the high consistency slurry.

5. The process of claim 1 wherein said crosslinked cellulosic fibers are present in at a level of at least 50 percent by weight of the total fiber in the high consistency slurry.

6. The process of claim 1 wherein said crosslinked cellulosic fibers are present in at a level of at least 60 percent by weight of the total fiber in the high consistency slurry.

7. The process in claim 1 wherein the crosslinked cellulosic fibers are citric acid crosslinked celluosic fibers.

8. The process in claim 1 wherein the crosslinked fibers are polyacrylic acid crosslinked cellulosic fibers.

9. The process of claim 1 wherein said screen with said rotor has a hole diameter of at least 3 mm.

10. The process of claim 1 wherein said screen hole with said rotor has a hole diameter of at least 4 mm.

11. The process of claim 1 wherein said rotor is a lobed rotor.

12. The process of claim 1 wherein said rotor is a foil rotor.

13. The process of claim 1 wherein said rotor is an S rotor.

14. The process of claim 1 wherein said rotor is a bump rotor.

* * * * *